United States Patent [19]

Crossley et al.

[11] Patent Number: 4,512,483

[45] Date of Patent: Apr. 23, 1985

[54] MODEL TRAIN COUPLER

[75] Inventors: David W. Crossley, Maple Shade, N.J.; Peter Van Dore, Elkins Park, Pa.

[73] Assignee: Mantua Metal Products Co., Inc., Woodbury Heights, N.J.

[21] Appl. No.: 496,613

[22] Filed: May 20, 1983

[51] Int. Cl.[3] ..... A63H 19/18

[52] U.S. Cl. ..... 213/75 TC; 213/211

[58] Field of Search ..... 213/75 TC, 211; 403/326, 329, 330

[56] References Cited

U.S. PATENT DOCUMENTS

| | | | |
|---|---|---|---|
| 2,411,394 | 11/1946 | Strayer | 213/75 GT X |
| 2,868,393 | 1/1959 | Bailey, Jr. | 213/75 TC |
| 3,134,489 | 5/1964 | Gillham | 213/75 TC |
| 3,140,783 | 7/1964 | Kretzmer, Jr. et al. | 213/75 R |
| 3,140,784 | 7/1964 | Goldbeck et al. | 213/75 TC |
| 3,564,766 | 2/1971 | Edwards et al. | 213/75 TC X |
| 3,662,489 | 5/1972 | Terrier | 213/75 TC X |
| 3,822,501 | 7/1974 | Kelterstr | 213/75 TC X |
| 3,831,776 | 8/1974 | Antonik | 213/75 TC |
| 3,939,989 | 2/1976 | Thomson | 213/75 TC |
| 4,098,411 | 7/1978 | Rössler | 213/75 TC |
| 4,335,820 | 6/1982 | Gramera | 213/75 TC |

*Primary Examiner*—Robert B. Reeves
*Assistant Examiner*—David F. Hubbuch
*Attorney, Agent, or Firm*—Robert K. Youtie

[57] ABSTRACT

A model train coupler for a truck having a pocket with an upright pivot pin, the coupler including a stem inserted endwise into the pocket and swingable on the pin, a laterally opening hook extending outwardly from the stem, an actuator depending from the closed side of the hook, and a guide extending resiliently from the stem partially across the open side of the hook, said hook having an outwardly convergent end portion for entering engagement between the hook and guide of a like coupler to interengage the hooks, and the actuator of a like coupler being engageable with a track cam to spread interengaging hooks laterally apart for uncoupling.

9 Claims, 7 Drawing Figures

MODEL TRAIN COUPLER

BACKGROUND OF THE INVENTION

In the provision of couplers for model trains, the object of accurate simulation requires the parts to be quite small, compounding the difficulties in manufacture, reliability of operation, and durability throughout a long useful life. Also, prior model train couplers tended to impart resultant lateral forces to the trucks and cars, which increased wear and frequency of damage, as well as increasing rolling drag, which results in less pulling power, less speed and more tendency to derail.

Applicant is aware of the below listed prior patents, most of which illustrate the above-mentioned problems:

| U.S. PAT. NO. | U.S. PAT. NO. |
|---|---|
| 2,631,740 | 3,662,489 |
| 2,868,393 | 3,831,776 |
| 3,134,489 | 3,939,989 |
| 3,140,783 | 4,098,411 |
| 3,140,784 | 4,335,820 |
| 3,564,766 | |

SUMMARY OF THE INVENTION

It is an important object of the present invention to provide a coupler for model trains which presents the appearance of a full size train coupler; is extremely simple in construction and entirely automatic in operation; readily adaptable to use with a wide variety of types and makes of model train rolling stock; is capable of quick, easy and entirely automatic coupling and uncoupling by remotely controlled operation; and effectively eliminates or minimizes the transmission of lateral forces between cars, so that trucks track better to virtually elixinate derailment problems, while rolling drag is reduced for pulling more cars with less power even through sharp turns; and which permits of quick and easy manual disconnection as for removal of cars from track.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
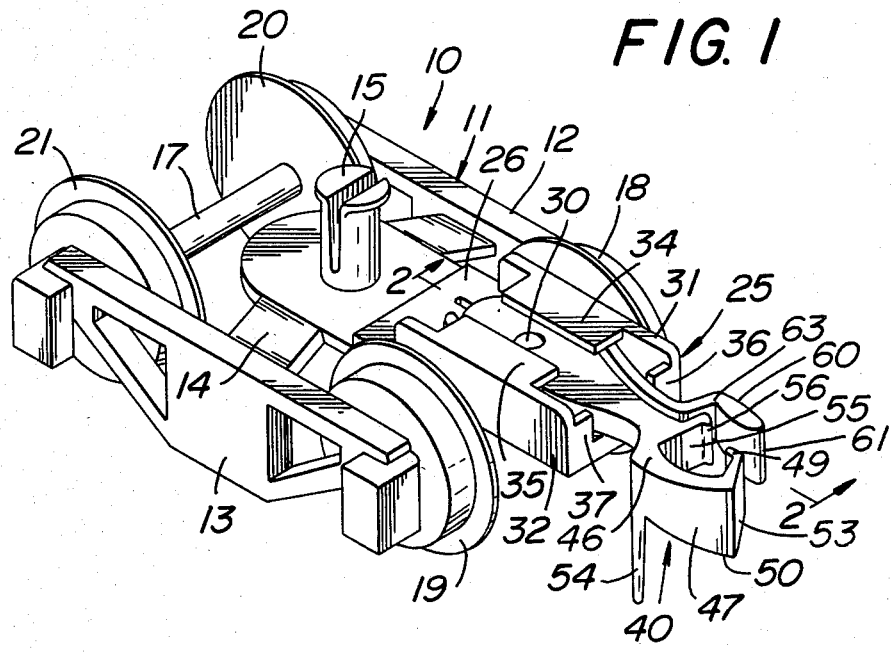
FIG. 1 is a top perspective view showing a model railroad truck including a coupler of the present invention.

Referring now more particularly to the drawings, and specifically to FIG. 1 thereof, a truck is there generally designated 10, being a truck of the type employed in model train rolling stock. The truck 10 includes a frame 11 composed of parallel, laterally spaced, longitudinally extending side pieces 12 and 13, which may be connected together by an intermediate cross piece 14. The frame side pieces 12 and 13, and cross piece 14 may be integrally fabricated, say of plastic, to form a rigid unit. Upstanding from the cross piece 14, medially thereof, may be a connection lug or stud 15 for connecting the frame pivotally to a car body (not shown).

Figure 2:
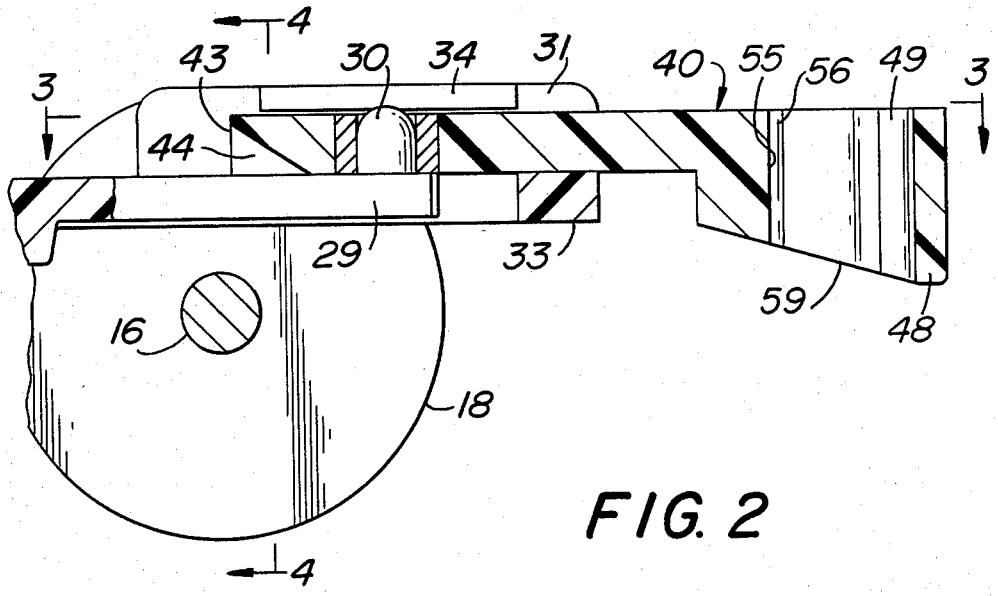
FIG. 2 is a longitudinal sectional view taken generally along the line 2—2 of FIG. 1.

Extending laterally between the adjacent ends of side pieces 12 and 13 may be axles or wheel shafts 16 and 17, see FIGS. 1 and 2. A pair of wheels 18 and 19 may be journaled on the shaft 16 adjacent to respective frame side pieces 12 and 13; and similarly a pair of wheels 20 and 21 may be journaled or rotatably supported by the shaft 17 adjacent to frame sides 12 and 13.

Extending from the frame cross piece 14, longitudinally of the truck 10 over one shaft 16 and outwardly beyond the adjacent wheels 18 and 19 is a coupler mount or receiver, generally designated 25. The receiver 25 may extend integrally from the cross piece 14, generally horizontally and longitudinally of the truck. The mount or receiver may include a generally flat, horizontal bottom wall 26 extending outwardly longitudinally of the truck and having a pair of laterally spaced, longitudinally inwardly extending slots 27 and 28. The slots 27 and 28 combine to define of the material therebetween a tongue 29 extending longitudinally outwardly beyond the wall 26 to define a vertically resiliently deflectable arm or leaf having on its outer end a vertically upstanding or upright projection or pin 30. Thus, the tongue or leaf 29 is located laterally medially of the truck 10, as is the pin or pintle 30.

Extending along the laterally outer sides or edges of the flat or bottom wall 26 are a pair of longitudinally extending, upright or vertically disposed side walls 31 and 32. That is, the side walls 31 and 32 extend generally horizontally, in laterally spaced apart relation on opposite sides of the spring tongue or arm 29 and longitudinally beyond the free end of the latter, as may be seen in FIG. 2. A laterally extending bottom wall portion or cross member 33 may extend between the longitudinally outer ends of the side walls 31 and 32, generally coplanar with the bottom wall 26. Thus, the side walls 31 and 32 upstand from the plane of the bottom wall parts 26 and 33; and top wall portions or parts 34 and 35 extend inwardly from the upper edges of the side walls 31 and 32, respectively, toward and terminating short of each other on opposite sides of the pin 30. Also, outer end wall portions or flanges 36 and 37 may upstand from the bottom wall part 33, extending inwardly from respective side walls 31 and 32.

The coupler mount 25 thus defines a pocket opening longitudinally outwardly from its outer end, between the end wall portions 36 and 37 for passing therebetween the coupler, generally designated 40.

Figure 3:
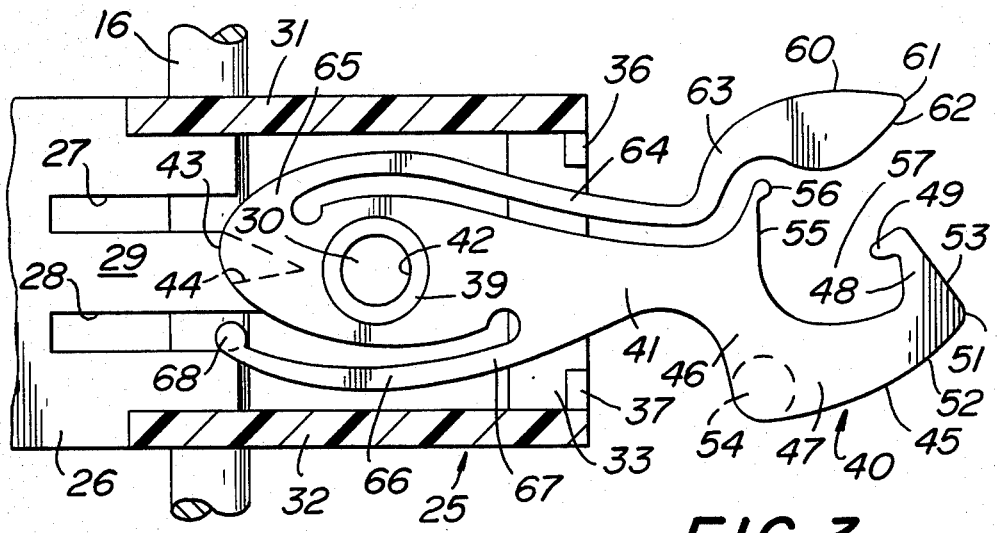
FIG. 3 is a horizontal sectional view taken generally along the line 3—3 of FIG. 2.
Figure 4:
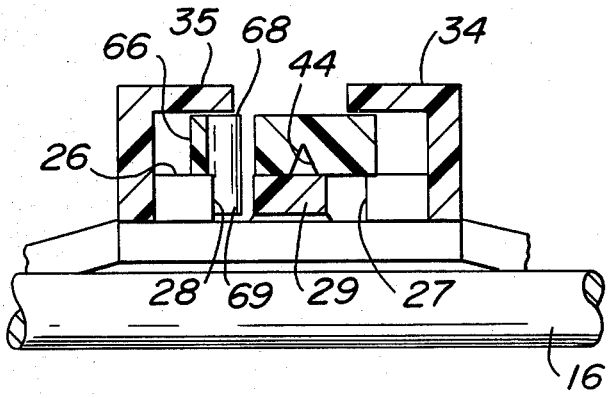
FIG. 4 is a transverse sectional elevational view taken generally along the line 4—4 of FIG. 2.

More specifically, the coupler 40 may include an elongate central stem or shank 41 having its inner end portion received in the pocket or mount 25. The stem or shank 41 is formed in its inner end with a through opening or hole 42 rotatably receiving the pin 30 in the assembled condition of FIGS. 1–3. A bushing or annular liner 43 may be provided in the stem or shank 41 defining the vertical through opening or hole 42 and providing a bearing for pin 30. The bushing or liner 39 may be removable, if desired, to accomodate larger sizes of pin 30.

Extending longitudinally inwardly from the innermost end 43 of the shank 41, on the underside thereof, may be an oblique guide notch, bevel or cut 44, for a purpose appearing presently.

Extending longitudinally outwardly from the outer end of the stem 41 is a hook 45. Specifically, the hook 45 includes an inner lateral portion 46 extending laterally from the outer end of the stem or shank 41; a longitudinal portion 47 extending generally longitudinally outwardly from the laterally outer region of the inner lateral portion 46; and an outer lateral portion 48 extending laterally inwardly from the longitudinally outer end of the longitudinal portion 47. It may be observed in FIG. 3 that the longitudinal portion 47 is laterally spaced from the center line of the stem 41, while the outer lateral portion 48 extends across the center line, terminating in a longitudinally inwardly projecting lug or ear 49 on the other side of the shank center line.

As may be seen in FIG. 1, the lower edge 50 of the longitudinal hook portion 47 declines in the longitudinally outward direction, so that the vertical extent of the longitudinal portion increases in the longitudinal outer direction. Also, at the longitudinal outer extremity of the hook 45, there is a juncture of the longitudinal hook portion 47 and outer lateral hook portion 48 at a generally vertical meeting edge 51. The outer surfaces 52 and 53 of the hook portions 47 and 48 diverge in the longitudinal inward direction approximately equal angles on opposite sides of a longitudinal line.

Depending from the hook 45, say from the juncture of hook portions 46 and 47, may be an arm or actuator member 54. Also extending from the outer end of the shank or stem 41 but laterally opposite to the hook member 46 is a stop element or abutment member 55 terminating in a longitudinally outward protrusion or bead 56. The stop element 55 and its terminal bead extend laterally beyond the outer lateral hook portion 48.

Thus it will now be apparent that the hook 45 opens laterally on one side, as at 57 between the protrusions 49 and 56. Also, the hook 45 opens vertically.

The coupler 40 further includes a guide 60 on the open side of hook 45 and extending partially across the opening 57. The guide 60 extends generally longitudinally of the assembly, having a longitudinal outer end 61 spaced laterally from the outer lateral hook portion 48, and having an inner or operating surface 62 extending at an angle to the hook surface 53, which angle has its bisector extending generally longitudinally of the assembly. The longitudinally inner end region 63 of the guide 60 is adjacent to and spaced laterally outwardly from the extremity or bead 56 of the stop element 55; and, the guide 60 extends from its inner end 63 by way of a resilient arm or leaf 64 for connection at its longitudinally inner end region 65 to the stem 41 at the longitudinally inner end of the latter. Thus, the guide 60 is mounted by the arm 64 to the stem 41 at a location on the latter longitudinally inwardly of the pivot pin 30. By this means the guide is resiliently laterally displaceable away from the hook 45.

The lower edge or underside 59 of the guide 60 declines longitudinally outwardly, as best seen in FIG. 2. Thus, the vertical extent of the guide 60 increases in a longitudinally outward direction, generally corresponding to the increase in vertical extent of the hook 45.

An additional arm 66 of resilient characteristic extends from a forward region 67 at a juncture with the stem 41 on one side of the stem opposite to the guide mounting arm 64 and spaced longitudinally between the pin 30 and stop element 65. From the foward end juncture 67, the arm 66 extends generally longitudinally inwardly beyond the pin 30 to a location proximate to the inner end 43 of the stem, as at 68. The free inner end 68 of the arm 66 is provided with a depending member or lug 69 entering freely into the slot or elongate opening 28.

The truck 10, absent the coupling 40 may be essentially conventional. In order to assemble the coupling 40 with the truck 10, it is only necessary to insert the inner end 43 of coupling shank 41 into the receiver pocket 25. The bevel or notch 44 will act as a ramp and displace the pin 30 downwardly by resilient deflection of the tongue 29. Upon continued inward insertion of the shank 41, the pin 30 will return upwardly into the shank opening 42. Simultaneously, the lug 69 on the free inner end of arm 66 enters the slot 28. The coupling 40 is thus mounted for limited rotation about the vertical axis of pin 30, as limited by engagement of the guide arm 64 with end wall 36 and the stem side edge 41 with the end wall 37. However, the resilience of arm 66 and freedom of lug 69 in slot 28 serves to permit this limited swinging movement of the coupler 40, while resiliently urging the coupler to return to a longitudinally aligned or essentially centered position, in the absence of turning force on the stem 41.

Figure 6:
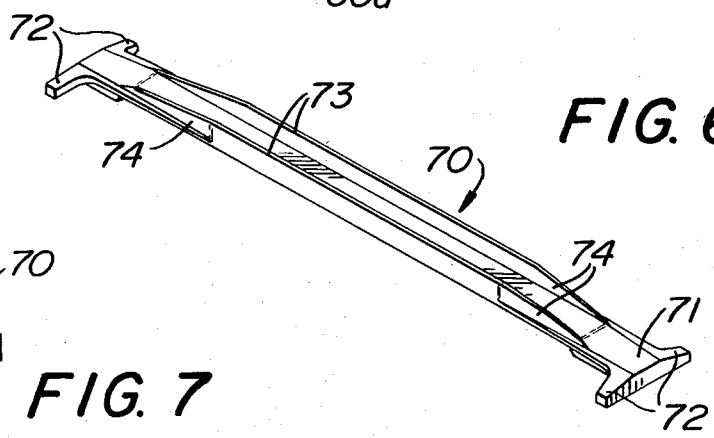
FIG. 6 is a plan view showing a cam for operating couplers of the present invention.
Figure 7:
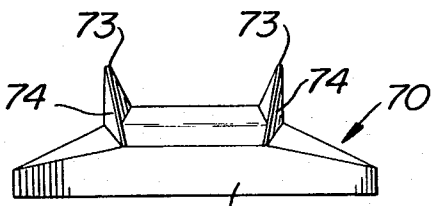
FIG. 7 is an end view of the cam.

In FIGS. 6 and 7 are shown an uncoupling cam or operator member 70 for location in a track bed to effect uncoupling, as desired. Specifically, the operator cam 70 includes an elongate base 71 having at opposite ends laterally outstanding members 72 for interengagement with the track structure at a selected location.

A pair of laterally spaced upstanding cam elements 73 extend longitudinally along opposite sides of the base 71. The end portions 74 of the cam elements 73 are of gradually decreasing height, so as to merge into the base 71. Further, the cam element end portions 74 are slightly curved laterally inwardly toward each other, see FIGS. 5 and 7.

Figure 5:
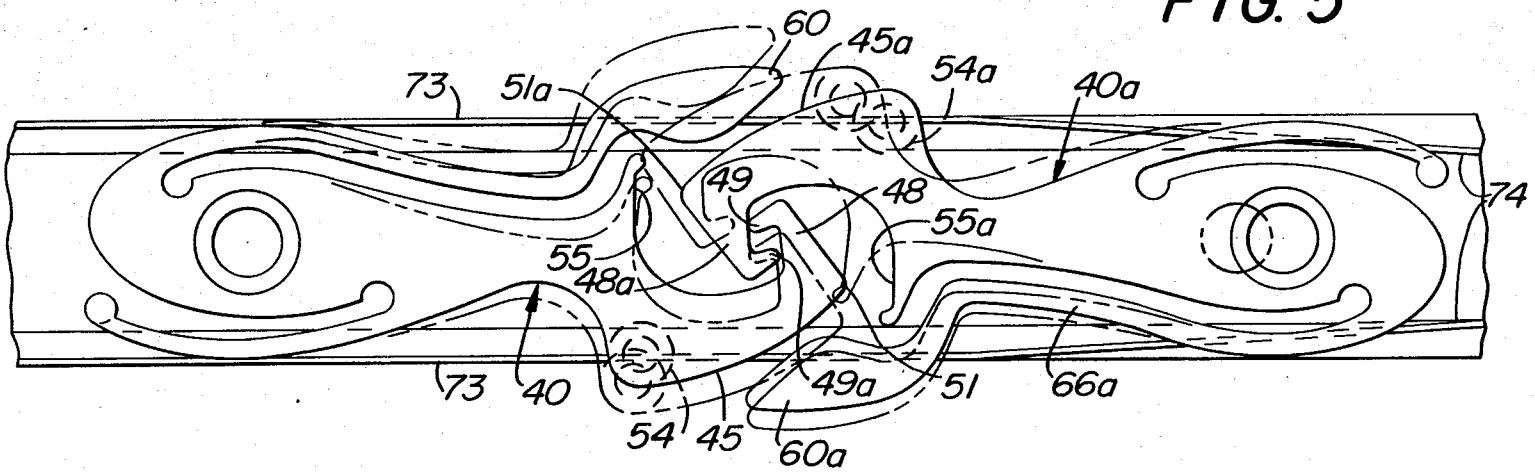
FIG. 5 is a top plan view, showing a pair of like couplers interengaged in coupled relation in solid lines, and showing a phantom position illustrating an intermediate stage in the coupling and uncoupling operation.

Further to FIG. 5, there is shown therein a pair of couplers 40 and **40*a*, being illustrated in solid lines in coupled relation under tension as in a train being pulled. That is, the hook 45 of coupler 40 has its outer lateral portion 48 located within the hook 45*a* of coupler 40*a*. Specifically, the protrusion 49 engages the inner side of outer hook portion 48*a* of coupler 40*a*; and similarly the protrusion 49*a* engages the outer hook portion 48 of coupler 40. In this coupled condition of a train being pulled the hooks are positively retained in interengagement and held against spreading apart by interference between the undercut protrusions 49 and 49*a*. With the train of cars in tension or compression, uncoupling of hooks is also resisted by the resilient urging force of the guides 60 and 60*a*** resisting lateral relative displacement of the hooks.

The solid line condition of FIG. 5 is that of tension between coupling elements, as in normal pulling operation of a train of cars. However, upon release of such tension and compression of cars end to end toward each other, as in deceleration sufficient to overcome rolling friction, it will be apparent that each outer hook portion 48 and 48*a* will engage with the stop element 55*a* and 55 of the other coupling element to limit relative movement of coupling elements toward each other. By means of the stop elements 55 and 55*a*, and more particularly by means of the beads 56 and 56*a*, the hook of one coupler is prevented from entering between the hook and guide of the other coupler, so that jamming of couplers and undue opening of hooks is prevented.

In order to uncouple a pair of coupled cars, it is only necessary to move the interengaged coupling elements over the operating cam 70 in the compressed condition of cars, as when a normally pulling engine is operated in reverse or when forward deceleration is great enough to overcome rolling friction. The actuators 54 and 54*a* will engage respective cams 73, being spread apart against the yielding resistance of guides 60*a* and 60, as shown in phantom in FIG. 5. The hook ends 49 and 49*a* are then displaced laterally sufficiently beyond each other to permit disengagement of the couplers. Therefore, upon removing reverse power from the train, the couplers disengage and, by momentum the uncoupled cars roll away from each other. In the case of forward deceleration, the resumption of forward acceleration will separate the uncoupled cars.

In order to effect coupling, it is only necessary to back one car toward another, to engage couplers, but in the absence of a cam 70. In coupling operation, the tapered, leading edge or junction 51 of one coupler will enter between the hook end portion 48*a* and guide 68*a* of the other coupling element. Simultaneously, the tapering hook end portion 51*a* of the coupler 40*a* will enter between and spread apart the hook end portion 48 and guide 60 of the coupler 40. The guides 60 and 60*a* are displaced laterally just sufficiently to pass the mating hook end portions 48*a* and 48, and simultaneously the hook end portions and their respective stems 41 and 41*a* are displaced slightly laterally in the opposite direction against the centering urging of arms 66 and 66*a*, so that lateral forces are minimized and substantially completely cancelled out, and there is little or no tendency toward derailment during coupling. This nullifying of lateral forces is believed to result from the angle between hook surfaces 52 and 53 being bisected by a substantial longitudinal line, and the angle between hook surface 53 and guide surface 62 similarly being bisected by a substantially longitudinal line.

Also, in the tension or load pulling mode, the forces transmitted between interengaged coupling elements are substantially aligned and generally radially of their pivot pins 30, to minimize or obviate lateral forces for optimized tracking drag.

From the foregoing, it is seen that the present invention provides a model train coupler which is extremely simple in construction, entirely automatic in operation, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A model train coupler for a truck including an outwardly opening pocket and a vertically retractile upright pin in said pocket, said coupler comprising an elongate stem having one end insertable into said pocket and having a receiver for rotatably receiving said pin to mount said stem for swinging movement about the axis of said pin, a hook extending outwardly from the other end of said stem away from said pocket, said hook facing inwardly toward said stem and having a lateral opening toward one side, an undercut protrusion on the end of said hook extending inwardly into said opening, an actuator depending from said hook on the other side from said opening, and a guide on said one side of said hook extending partially across said opening and resiliently mounted on said stem for yieldable movement away from said opening, said guide having a laterally inner operating surface configured for engagement with a hook of a like coupler to interengage the hooks upon movement toward each other with the hook protrusions in interfering engagement to resist lateral separation of the coupled hooks when the cars of a train are extended apart, and said actuator and the actuator of a like coupler being engageable with a track cam when the train is decelerated in the forward direction or being pushed in reverse to compress the cars of the train to disengage the protrusions and spread the interengaging hooks laterally apart from each other against the yieldability of said guides for uncoupling the couplers, said guide being entirely clear on its underside to remain spaced from the track cam at all times.

2. A model train coupler according to claim 1, in combination with a stop element on the inner end of said hook for limiting abutment with an interengaging hook when a train is compressed, so that lateral spreading of hooks and yielding of guides occurs only during deliberate uncoupling by said actuators.

3. A model train coupler according to claim 1, in combination with a ramp on the inner end of said stem for effecting retraction of said pin upon insertion of said stem.

4. A model train coupler according to claim 1, in combination with a laterally resilient centering arm extending from said stem in sliding engagement longitudinally of and within said pocket for resiliently urging said coupler toward a medial position in longitudinal alignment in said pocket from misalignment positions on opposite sides of said medial position.

5. A model train coupler according to claim 4, said centering arm extending from said stem at a region thereof outwardly of said receiver generally longitudinally inwardly to terminate in a free end inwardly of said receiver, said free end being in sliding engagement longitudinally within said pocket.

6. A model train coupler according to claim 5, in combination with an elongate resilient leaf extending from said stem at a region thereof inwardly of said receiver generally longitudinally outwardly to said guide to mount the latter for laterally resilient yielding movement.

7. A model train coupler according to claim 6, in combination with a stop element on the inner end of said hook for limiting abutment with an interengaging hook when the cars of a train are compressed, so that lateral spreading of hooks and yielding of guides occurs only during deliberate uncoupling as effected by said actuators.

8. A model train coupler according to claim 1, said hook being open vertically and said guide being spaced laterally from said hook, for manual vertical removal and reception of a like hook out of and into said interengaging hook relation with a like guide on the opposite side of said first mentioned hook as said first mentioned guide.

9. A model train coupler according to claim 1, said hook having an outwardly convergent outer end portion for entering engagement between the hook and guide of a like coupler, and said guide being resiliently mounted on said stem for approximately equal outward guide deflection and outward stem swinging movement during hook interengagement, to effectively cancel out opposite lateral forces applied to a truck during coupling and minimize the possibility of derailment.

* * * * *